United States Patent [19]

Nagato

[11] 4,291,879

[45] Sep. 29, 1981

[54] BALL HITTING GAME

[75] Inventor: Nobuo Nagato, Tokyo, Japan

[73] Assignee: Ohkuma Seisakusho Co., Ltd., Japan

[21] Appl. No.: 150,008

[22] Filed: May 15, 1980

[30] Foreign Application Priority Data

Aug. 11, 1979 [JP] Japan ..... 54-110936[U]

[51] Int. Cl.[3] ..... A63D 3/02

[52] U.S. Cl. ..... 273/119 R; 273/392; 273/384

[58] Field of Search ..... 273/119 R, 392, 384, 273/121 R, 121 A, 121 E, 119 A, 119 B, 122 R

[56] References Cited

U.S. PATENT DOCUMENTS 4,054,287 10/1977 Goldfarb et al. ..... 273/119 R X 4,245,842 1/1981 Kuna et al. ..... 273/357

*Primary Examiner*—George J. Marlo

*Attorney, Agent, or Firm*—Steinberg & Raskin

[57] ABSTRACT

Disclosed is a toy for playing a ball-hitting game. This toy comprises a body member having a ball-rolling face on which a ball may be rolled, a ball container disposed on one end of the ball-rolling face to store the ball therein, a ball discharge device for discharging the ball stored in the ball container means onto the ball-rolling face, a ball-hitting member for hitting the ball discharged onto the ball-rolling face by the ball discharge device, a magazine disposed on the other end of the ball-rolling face to store therein a plurality of target blocks in a stacked relation, a target block discharge element disposed on the lower portion of the magazine for discharging target blocks stored in the magazine one by one from the magazine through an impinging force of the ball rolling on the ball-rolling face, and a pocket arranged adjacently to the magazine to receive each of the target blocks discharged by the target block discharge element, wherein the ball-rolling face of the body member is sloped so that the ball on the ball-rolling face is ordinarily rolled from the magazine toward the ball container.

12 Claims, 5 Drawing Figures

BALL HITTING GAME

BACKGROUND OF THE INVENTION

The present invention relates to a toy for a ball-hitting game. More particularly, the present invention relates to a toy for a ball-hitting game in which a ball rolling on a slope face is hit back by a ball-hitting lever on one end of the slope face and target blocks stacked on the other end of the slope face are striken down one by one from the lower target blocks into a pocket by an impinging force of the ball.

Various toys for playing a ball-hitting game of this type have been known, but their structures are complicated and it is difficult to provide these toys at low costs. Moreover, they are defective in that they readily get out of order. The structure of the target section for striking down target blocks one by one by an impinging force of a rolling ball is complicated and a trouble is readily caused in this target section, and this trouble often renders playing impossible.

SUMMARY OF THE INVENTION

It is therefore a primary object of the present invention to provide a toy for playing a ball-hitting game, in which the structure is simple and occurrence of a trouble or disorder is remarkably reduced.

Another object of the present invention is to provide a toy for playing a ball-hitting game, which can be manufactured at a low cost.

In accordance with the fundamental aspect of the present invention, there is provided a toy for playing a ball-hitting game, which comprises a body member having a ball-rolling face on which a ball may be rolled, ball container means disposed on one end of the ball-rolling face to store the ball therein, ball discharge means for discharging the ball stored in the ball container means to said ball-rolling face, ball-hitting means for hitting the ball discharged to the ball-rolling face by said ball discharge means, magazine means disposed on the other end of the ball-rolling face of said body member to store therein a plurality of target blocks in a stacked relation, target block discharge means disposed in the lower portion of said magazine means for discharging target blocks stored in the magazine means one by one from the magazine means through an impinging force of the ball rolling on the ball-rolling face, and pocket means arranged adjacently to said magazine means to receive each of the target blocks discharged by the target block discharge means, wherein the ball-rolling face of the body member is sloped so that the ball on the ball-rolling face is ordinarily rolled from said magazine means toward said ball container means.

In the toy for playing a ball-hitting game according to the present invention, every time the game is started, a ball is sprung out to the ball-rolling face of the body member from the ball container means, and while this ball is present on the ball-rolling face, the ball can be hit repeatedly against a plurality of target blocks stacked on one end of the rolling face. If a player fails to hit the ball, the ball on the rolling face is discharged from the rolling face and one game is terminated.

Said magazine means comprises a plurality of magazines, and an opening communicated with the pocket means from the ball-rolling face is formed in the lower portion of each magazine. A swinging plate rotatable toward the interior of this opening by a predetermined angle is pivoted on this opening on the side of the ball-rolling face.

Said ball-hitting means comprises a pair of pressing members slidably attached to said body member and urged by a return spring and a pair of ball-hitting levers operatively connected to said pressing members. The ball-hitting levers are arranged turnably on the ball-rolling face, and the top ends of the ball-hitting levers confront each other with a predetermined distance therebetween.

Said ball container means has an opening exposed to the distance between the top ends of said paired ball-hitting levers, and said ball discharge means includes a pressing plate urged by a return spring and mounted on the upper portion of said ball container means.

BRIEF DESCRIPTION OF THE DRAWINGS

For a more complete understanding of the invention, reference is had to the following description taken in connection with the accompanying drawings, in which.

DETAILED DESCRIPTION OF THE PREFERRED EMBODIMENTS

Figure 1:
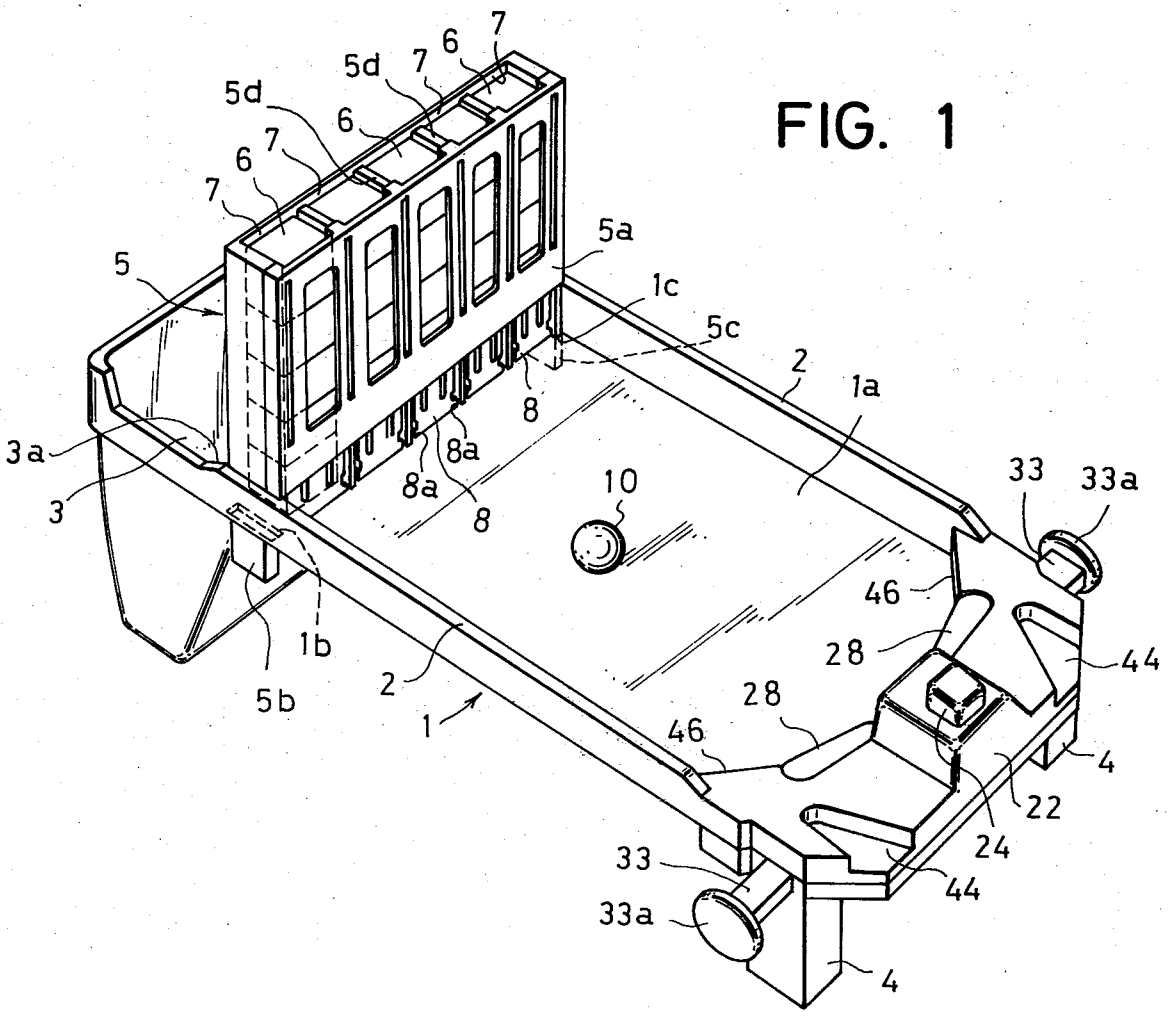
FIG. 1 is a perspective view showing one embodiment of the present invention.

Referring now to FIG. 1, one embodiment of a toy for playing a ball-hitting game, which is constructed and arranged according to the present invention, will be illustrated.

A game board 1 has a ball-rolling face 1*a* surrounded by vertical rising edge walls 2 and the forward portion is supported by a pocket 3 acting also as a supporting leg and the portion close to a player is supported by a pair of left and right supporting legs 4, 4. The height of the pocket 3 is made slightly larger than that of the supporting legs 4, 4, so that the rolling face 1*a* is inclined downward to the portion close to a player.

On one end of the rolling face 1*a*, a magazine member 5 for storing target blocks, described hereinafter, in the state stacked therein is mounted along the open edge 3*a* of the pocket 3 having the top face thereof opened so that the magazine member 5 can optionally be dismounted, for example, legs 5*b* and 5*c* on both the sides of the magazine member 5 are inserted in receiving holes 1*b* and 1*c* formed on the rolling face 1*a*. A ball-hitting member described hereinafter is contructed on the other end of the rolling face 1*a*.

Figure 2:
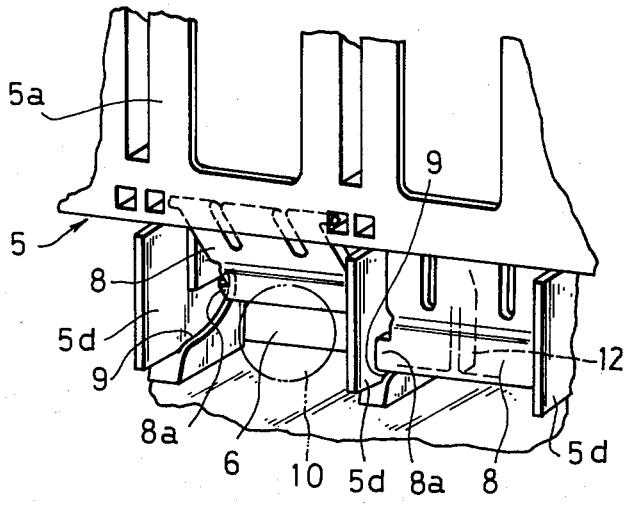
FIG. 2 is a perspective view showing the operation state of magazine means for storing target blocks therein according to the embodiment of the present invention.
Figure 3:
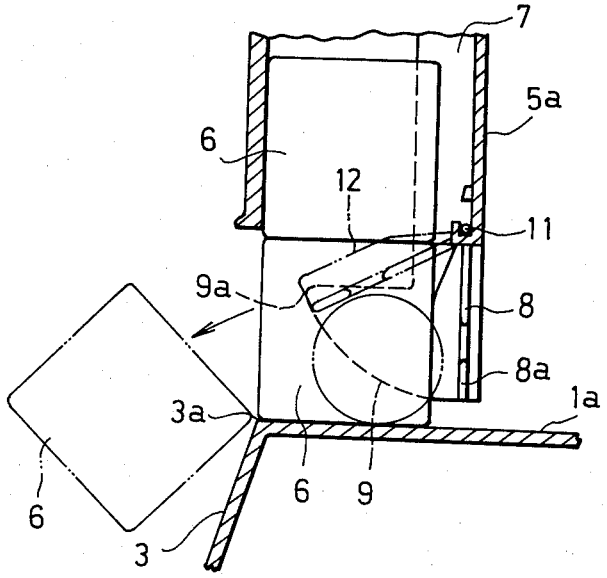
FIG. 3 is a side view illustrating magazine means shown in FIG. 2.

The magazine member 5 is divided by each partition wall 5*d* into a plurality of magazines 7 capable of storing rectangular or cubic target blocks 6 in the stacked state, and each magazine 7 has a sectional shape such that each block 6 is received from the opened top face thereof. As shown in FIGS. 2 and 3, in the lower portion of each magazine 7, the faces confronting the rolling face 1*a* and the pocket 3, that is, the front and back faces, are opened, and a swinging plate 8 made of a transparent plastics is turnably disposed on the side of the opened front face. Projections 8*a* slightly projected from the lower side of the swinging plate 8 to the left and right are located on arcuate notched edges 9 formed on the wall faces of respective partition walls 5*d* of the magazine 7, so that when the swinging plate 8 is turned inward, the projection 8*a* impinges against the inner end 9*a* of the notched edge 9 to prevent further turning of the swinging plate 8.

The front face portion 5*a* of the magazine member 5 is formed as a transparent so that target blocks 6 stored in the respective magazines 7 can be seen from the outside. In FIG. 3, reference numeral 11 represents a pivoting shaft for the swinging plate 8 and reference numeral 12 represents a rib projected in the back face portion of the swinging plate 8. This rib 12 acts as a pressing member for pressing target blocks 6 backward as well as reinforcing the swinging plate 8.

Figure 4:
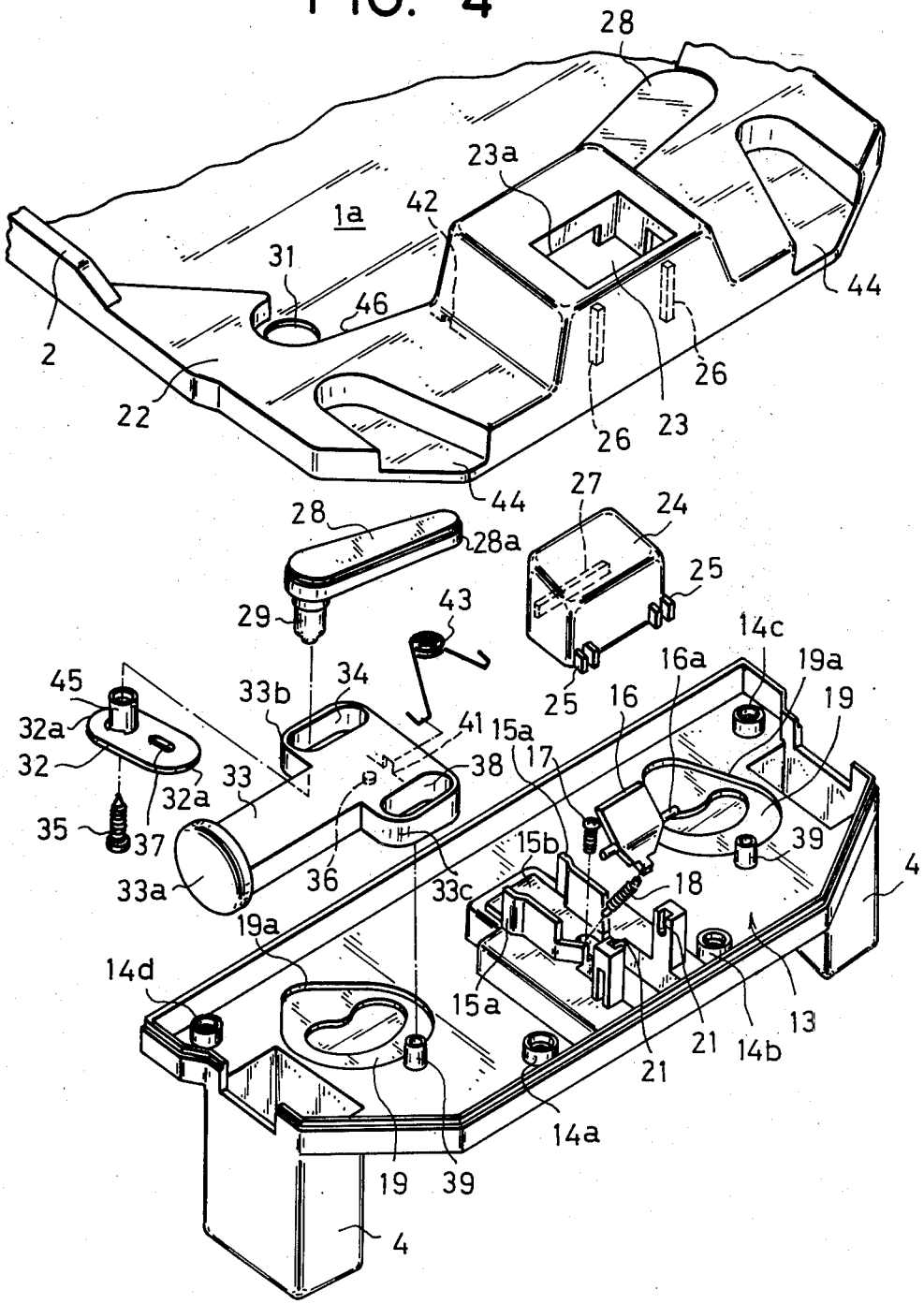
FIG. 4 is a fragmentary perspective view illustrating ball-hitting member according to one embodiment of the present invention.
Figure 5:
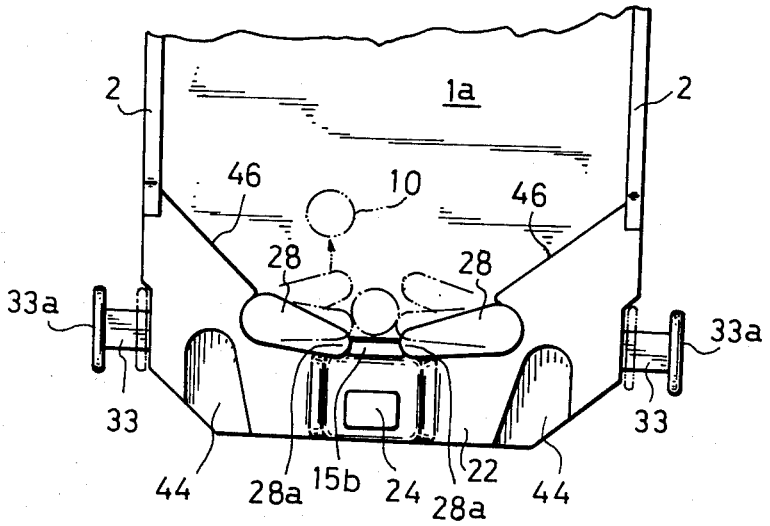
FIG. 5 is a plan view showing the state where a ball is hit by ball-hitting levers according to one embodiment of the present invention.

Referring now to FIGS. 4 and 5, ball-hitting member constructed and arranged on the other end of the rolling face 1*a* will be described.

As illustrated in detail in FIG. 4, the portion, close to a player, of the game board 1 is fitted to a base plate 13 having the supporting legs 4, 4 mounted thereon and is fixed by screws (not shown) inserted from the lower face in screw portions 14*a* to 14*d*. Holding enclosures 15*a*, 15*a* are formed on the base plate 13 to receive a ball 10 (shown in FIG. 5) and temporarily store it therein. An outlet 15*b* is formed on the side of the front faces of both the enclosures 15*a*, 15*a* so that the face of the outlet 15*b* is contiguous to the rolling face 1*a* on the same plane. On the side of the rear faces of both the enclosures 15*a*, 15*a*, a pressing plate 16 is mounted turnably toward the top faces of the holding enclosures 15*a*, 15*a*. More specifically, a return spring 18 having one end fixed to the base plate 13 by a screw 17 is attached to the pressing plate 16 so that the plate 16 is normally held in the state inclined upward to the front side. Recesses 19, 19 for guiding pressing members described hereinafter are formed on the base plate 13 on the sides of the holding enclosures 15*a*, 15*a*. In the Figures, reference numeral 21 represents a portion for supporting a shaft 16*a* of the pressing plate 16.

The portion, close to a player, of the game board 1 fitted to the base plate 13 is constructed as a cover 22 slightly elevated over the rolling face 1*a*, and a push button 24 is freely fitted in a fitting opening 23 formed in the central portion of the cover 22 so that the push button 24 butts agains the pressing plate 16. Engaging members 25, 25 mounted in the back portion of the push button 24 are engaged with projections 26, 26 projected on the inner face of the rear portion of the fitting opening 23. A rib 27 formed in the front portion of the push button 24 is arranged so that when the push button 24 is raised (in the off state), the rib 27 impinges against the front face edge 23*a* of the fitting opening 23 and is brought in contact therewith, whereby the vertical movement of the push button 24 is guided and the push button 24 is prevented from falling out from the fitting opening 23.

On the front face side of the cover 22, a pair of left and right ball-hitting levers 28, 28 are attached turnably along the rolling face 1*a*, and the top ends 28*a* of the ball-hitting levers 28, 28 are exposed to a front face of the outlet 15*b* of the holding enclosures 15*a*, 15*a* and as shown in FIG. 5, a distance allowing passage of the ball 10 is formed between the confronting top ends 28*a* of the ball-hitting levers 28, 28. Shafts 29 projected from the bases of both the ball-hitting levers 28, 28 extend through pivoting holes 31 formed on the side edge of the portion, close to a player, of the rolling face 1*a* and are connected through interconnecting pieces 32 to left and right pressing members 33 slidably mounted between the base plate 13 and the cover 22, so that the ball-hitting levers 28, 28 are turned when press portions 33*a* on the outer ends of the pressing members 33, 33 projected from the side face of the game board 1 are depressed. More specifically, as shown in the drawings, each pressing member 33 has a substantially T-figured shape, and a pivoting shaft 29 is loosely inserted in an elongated hole 34 formed in one wing portion 33*b* of the T-shaped pressing member 33. The interconnecting piece 32 butting against the lower side of the pressing member 33 is fixed to the pivoting shaft 29 by means of a screw 35, while a projection 36 formed on the lower face of the pressing member 33 is loosely inserted in an elongated hole 37 formed on the interconnecting piece 32. In this arrangement, each ball-hitting lever 28 is turned cooperatively with the sliding movement of the pressing member 33.

A guide projection 39 formed on the base plate 13 is loosely inserted in an elongated hole 38 formed on the other wing portion 33*c* of the T-shaped pressing member 33 to guide the sliding movement of the pressing member 33. A return spring 43 is disposed between a stopper 41 formed on the lower face of the pressing member 33 and a stopper 42 formed on the inner face of the cover 22 to normally hold the ball-hitting lever 28 and pressing member 33 in the non-operating state indicated by solid lines in FIG. 5. The above-mentioned interconnecting piece 32 is contained in the above-mentioned guide recess 19 and both the ends 32*a*, 32*a* of the interconnecting piece 32 are kept in sliding contact with the peripheral edge 19*a* of the guide recess 19 to prevent the interconnecting piece 32 from rattling during the turning movement of the ball-hitting lever 28. Finger-placing portions 44, 44 are formed on the left and right sides of the cover 22 so that thumbs are placed on these portions 44, 44.

In the drawings, reference numeral 45 represents a screw-inserting portion projected on the interconnecting piece 32, and inclined guide surface portions 46, 46 for guiding the ball 10 into the holding enclosures 15*a*, 15*a* are formed on the left and right sides of the front face of the cover 22.

In the toy having the above-mentioned structure and the arrangement, when the push button 24 is depressed, a ball 10 is striken out onto the ball-rolling face 1*a* from the interior defined by the holding enclosures 15*a*, 15*a* by the pressing plate 16 and the ball 10 is always rolled on the rolling face 1*a* toward the portion close to a player, that is, toward the ball-hitting levers 28, 28. Accordingly, this ball 10 can be hit back by the ball-hitting levers 28, 28 turned by operating the pressing members 33, 33.

More specifically, the ball 10 is hit back by one of the left and right ball-hitting levers 28, 28 while taking aim at the swinging plate 8 formed on any of the magazines 7, and when the ball 10 is striken onto the swinging plate 8, the swinging plate 8 is turned and the lowermost target block 6 among the target blocks 6 stored in the corresponding magazine 7 is pressed by the swinging plate 8, whereby, as shown in FIG. 3, the target block 6 is pushed out to the back face of the magazine 7 and is let to fall down into the pocket 3. At this point, the subsequent target block 6 stacked in the magazine 7 is not allowed to fall down on the rolling face 1*a* before return of the swinging plate 8 to an original position, that is, before release of pressing of the swinging plate 8 by the ball 10. Accordingly, the target blocks 6 are pushed out one by one regularly by the swinging plate 8. The ball 10 striken against the swinging plate 8 is inhibited from intruding into the magazine 7 beyond a certain limit by the above-mentioned turning angle regulation of the swinging plate 8 per se and is rolled on the rolling face 1*a* again toward the portion close to a player. If the operation of hitting back the thus rolling ball 10 is repeated, target blocks 6 stacked and stored in the respective magazines 7 can be striken down into the pocket 3 in turn. When a player fails to hit the ball 10 by the ball-hitting lever 28 and the ball 10 escapes into the holding closures 15*a*, 15*a*, the push button 24 is violently depressed to press the pressing plate 16, and the ball 10 is striken out onto the rolling face 1*a* by the turning movement of the pressing plate 16. Thus, the game is started again.

In the ball-hitting game toy according to the present invention, since the left and right pressing members 33, 33 can optionally be operated by forefingers while the left and right thumbs are placed on the finger placing portions 44, the hitting operation can be performed very stably under precise control. The turning angle of the swinging plate 8 is regulated so that the ball 10 is prevented from pushing up the swinging plate 8 so widely as to allow passage of the ball 10 through the swinging plate 8 into the pocket 3. This critical turning angle is determined according to the length of the notched edge 9.

In the toy having the above-mentioned structure and the arrangement according to the present invention, the ball is prevented from unduly rolling out from the rolling face 1*a*, and therefore, the ball-hitting game can be enjoyed very stably. Moreover, the ball-hitting operation can be controlled precisely and easily by fingers, and target blocks can be striken down one by one assuredly and stored in the pocket. Therefore, the pleasure of the ball-hitting game can be remarkably increased.

What is claimed is:

1. A toy for playing a ball-hitting game comprising, a body member having a ball-rolling face on which a ball may be rolled;

ball container means disposed on one end of said ball-rolling face to store said ball therein;

ball discharge means for discharging said ball stored in said ball container means onto said ball-rolling face;

ball-hitting means for hitting said ball discharged onto said ball-rolling face by said ball discharge means;

magazine means disposed on the other end of said ball-rolling face to store therein a plurality of target blocks in a stacked relation;

target block discharge means disposed on the lower portion of said magazine means for discharging target blocks stored in said magazine means one by one from said magazine means through an impinging force of said ball rolling on said ball-rolling face; and pocket means arranged adjacently to said magazine means to receive each of said target blocks discharged by said target block discharge means;

wherein the ball-rolling face of said body member is sloped so that the ball on said ball-rolling face is ordinarily rolled from said magazine means toward said ball container means.

2. A toy as claimed in claim 1, wherein said magazine means comprises a plurality of magazines, each magazine has a hollow interior space for storing therein said target blocks in the stacked relation, and an opening extended from the ball-rolling face to the pocket means is formed in the lower portion of each magazine for discharging said target blocks one by one.

3. A toy as claimed in claim 2, wherein said target block discharge means includes a swinging plate pivotally mounted on the lower portion of each magazine on the side facing the ball-rolling face so that the swinging plate can turn toward the interior of said opening by a predetermined angle.

4. A toy as claimed in claim 3, wherein said ball-hitting means includes a pair of pressing members slidably attached to said body member and urged by a return spring and a pair of ball-hitting levers operatively connected to said pressing members, said ball-hitting levers are arranged so that they can turn along said ball-rolling face and the top ends of said ball-hitting levers confront each other with a certain distance therebetween.

5. A toy as claimed in claim 4, wherein said ball container means includes an opening exposed to said distance between the top ends of said ball-hitting levers to receive the ball therein and a pair of holding enclosures connected to said opening.

6. A toy as claimed in claim 5, wherein said ball discharge means includes a pressing plate mounted on the upper portion of said ball container means and urged by a return spring and a push button operatively connected to said pressing plate.

7. A toy as claimed in claim 6, wherein said ball-rolling face of said body member is surrounded partially by vertical rising walls.

8. A toy as claimed in claim 6, wherein said magazine means is dismountable from said body member.

9. A toy as claimed in claim 6, wherein said magazine means is divided in said magazines by partition walls, and the turning movement of the swinging plate pivotally mounted on the lower portion of each magazine is controlled by notched edges formed on the faces of the partition walls.

10. A toy as claimed in claim 6, wherein a front wall of each magazine is transparent so that the target blocks stacked and stored in the magazine can be seen from the outside.

11. A toy as claimed in claim 6, wherein a rib is projected on the back face of the swinging plate.

12. A toy as claimed in claim 5, wherein said pocket means is a pocket which also acts as a leg member for said body member.

* * * * *